US009561933B2

(12) United States Patent
Koba

(10) Patent No.: US 9,561,933 B2
(45) Date of Patent: Feb. 7, 2017

(54) SYSTEM FOR CONTROLLING ELEVATORS AS A GROUP

(75) Inventor: Yoshimasa Koba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 422 days.

(21) Appl. No.: 14/347,334

(22) PCT Filed: Nov. 28, 2011

(86) PCT No.: PCT/JP2011/077385
§ 371 (c)(1),
(2), (4) Date: Mar. 26, 2014

(87) PCT Pub. No.: WO2013/080276
PCT Pub. Date: Jun. 6, 2013

(65) Prior Publication Data
US 2014/0231178 A1 Aug. 21, 2014

(51) Int. Cl.
*B66B 1/34* (2006.01)
*B66B 3/00* (2006.01)

(52) U.S. Cl.
CPC ..... *B66B 3/006* (2013.01); *B66B 2201/103* (2013.01); *B66B 2201/23* (2013.01)

(58) Field of Classification Search
CPC . B66B 3/006; B66B 2201/23; B66B 2201/103
(Continued)

(56) References Cited

U.S. PATENT DOCUMENTS 6,065,570 A * 5/2000 Friedli ..... B66B 1/2458 187/387
7,021,429 B2 * 4/2006 Hikita ..... B66B 1/462 187/391
(Continued)

FOREIGN PATENT DOCUMENTS

JP 62 205978 9/1987
JP 8 81147 3/1996
(Continued)

OTHER PUBLICATIONS

International Preliminary Report on Patentability and Written Opinion issued Jun. 12, 2014 in PCT/JP2011/077385 (submitting English language translation only).
(Continued)

*Primary Examiner* — Anthony Salata
(74) *Attorney, Agent, or Firm* — Oblon, McClelland, Maier & Neustadt, L.L.P.

(57) ABSTRACT

In an elevator system, upon registration of a hall destination call from a call registration device, a group control device determines an assigned car caused to respond to the hall destination call. An assigned car notification device indicates information on the determined assigned car correlating the information to a service floor of the assigned car. The group control device determines whether or not a hall destination call registered from the call registration device meets a prescribed review condition, and if affirmative, the group control device does not perform a final determination of an assigned car immediately after registration. Upon final determination of an assigned car for a hall destination call meeting the review condition by the group control device, the assigned car notification device indicates only information on the assigned car and a service floor corresponding to the hall destination call on the indicator for a prescribed period of time.

7 Claims, 5 Drawing Sheets

(58) Field of Classification Search
USPC ..... 187/247, 380–389, 391, 392, 396
See application file for complete search history.

(56) References Cited

U.S. PATENT DOCUMENTS

| | | | | |
|---|---|---|---|---|
| 7,036,635 | B2 * | 5/2006 | Rintala | B66B 1/20 187/391 |
| 7,040,458 | B2 * | 5/2006 | Forsythe | B66B 1/34 187/389 |
| 7,404,469 | B2 * | 7/2008 | Takeuchi | B66B 1/463 187/380 |
| 7,469,772 | B2 * | 12/2008 | Takeuchi | B66B 3/02 187/381 |
| 8,157,059 | B2 * | 4/2012 | Takeuchi | B66B 3/00 187/391 |
| 8,403,113 | B2 * | 3/2013 | Takeuchi | B66B 3/02 187/391 |
| 8,496,091 | B2 * | 7/2013 | Wu | B66B 3/00 187/391 |
| 8,646,581 | B2 * | 2/2014 | Iwata | B66B 1/468 187/387 |
| 8,662,256 | B2 * | 3/2014 | Asano | B66B 1/2458 187/380 |
| 8,776,954 | B2 * | 7/2014 | Wu | B66B 3/00 187/391 |
| 2011/0132699 | A1 | 6/2011 | Tokura et al. | |
| 2011/0155515 | A1 | 6/2011 | Suzuki et al. | |

FOREIGN PATENT DOCUMENTS

| | | |
|---|---|---|
| JP | 2001 287876 | 10/2001 |
| JP | 2010 032307 | 3/2010 |
| JP | 2011 42490 | 3/2011 |
| JP | 2011 144012 | 7/2011 |
| KR | 10-2011-0042373 A | 4/2011 |
| WO | 2010 032623 | 3/2010 |

OTHER PUBLICATIONS

Japanese Office Action issued Nov. 11, 2014, in Japan Patent Application No. 2013-546859 (with partial English translation).
Combined Office Action and Search Report issued May 22, 2015 in Chinese Patent Application No. 201180074754.6 (with Partial English translation and English translation of Category of Cited Documents).
International Search Report Issued Apr. 17, 2012 in PCT/JP11/077385 Filed Nov. 28, 2011.
Office Action issued Sep. 16, 2015 in Korean Patent Application No. 10-2014-7013086 (with English language translation).

* cited by examiner

S101: DOES HALL DESTINATION CALL MEET REVIEW CONDITION?
S106: WAS ASSIGNED CAR DETERMINED?
S108: HAVE PRESCRIBED SECONDS ELAPSED?

SYSTEM FOR CONTROLLING ELEVATORS AS A GROUP

TECHNICAL FIELD

The present invention relates to an elevator system which controls a plurality of elevators as a group.

BACKGROUND ART

In a building where there are many elevator users, a plurality of elevators are installed in the building. In such a building, a group control device is often provided in order to improve the operation efficiency of all of the elevators. The group control device performs what is called group control, which involves controlling a plurality of elevators installed in the building as a group.

Patent Literature 1 to Patent Literature 3 below propose elevator systems provided with a group control device.

In a system described in Patent Literature 1, a call registration device for registering hall destination calls is installed in an elevator hall. In this system, when an assigned car which is caused to respond to a hall destination call is determined, information on this assigned car is indicated on an indicator by being correlated to a service floor.

In systems described in Patent Literature 2 and Patent Literature 3, a call registration device for registering hall destination calls is installed in an elevator hall. In these systems, a review of assigned cars is performed for hall destination calls registered from the call registration device.

CITATION LIST

Patent Literature

Patent Literature 1: Japanese Patent Laid-Open No. 2001-287876

Patent Literature 2: International Publication No. WO2010/032623

Patent Literature 3: International Publication No. WO2010/032307

SUMMARY OF INVENTION

Technical Problem

In the elevator systems described in Patent Literature 1 to Patent Literature 3, information on an assigned car is indicated on an indicator by being correlated to a service floor of the assigned car. However, in such a simple indication method, in the case where a review of an assigned car is performed, a user might be unaware of the change in the assigned car.

If a user boards the previous assigned car without being aware of the change in the assigned car, a useless call occurs, resulting in a substantial decrease in the operation efficiency.

The present invention was made to solve the problem described above, and an object of the present invention is to provide an elevator system capable of appropriately notifying a user of a car to be boarded by the user even in the case where an assigned car is not finally determined immediately after the registration of a hall destination call.

Solution to Problem

An elevator system of the invention is a system which controls a plurality of elevators as a group. The system comprises a call registration device which is installed in an elevator hall and by use of which a user registers a hall destination call, a group control device which upon registration of a hall destination call from the call registration device, determines an assigned car which is caused to respond to the hall destination call, and an assigned car notification device which is installed in the hall and indicates, on an indicator, information on an assigned car determined by the group control device by correlating the information to a service floor of the assigned car. The group control device makes a determination as to whether or not a hall destination call registered from the call registration device meets a prescribed review condition and does not perform a final determination of an assigned car immediately after registration of a hall destination call which meets the review condition. Upon final determination of an assigned car for a hall destination call meeting the review condition by the group control device, the assigned car notification device indicates only information on the assigned car and a service floor corresponding to the hall destination call on the indicator for a prescribed period of time.

Advantageous Effect of Invention

According to the present invention, in an elevator system which controls a plurality of elevators as a group, it is possible to appropriately notify a user of a car to be boarded by the user even in the case where an assigned car is not finally determined immediately after the registration of a hall destination call.

DESCRIPTION OF EMBODIMENT

The present invention will be described in detail with reference to the accompanying drawings. In each of the drawings, identical numerals refer to identical or corresponding parts. Redundant descriptions are appropriately simplified or omitted

First Embodiment

Figure 1:
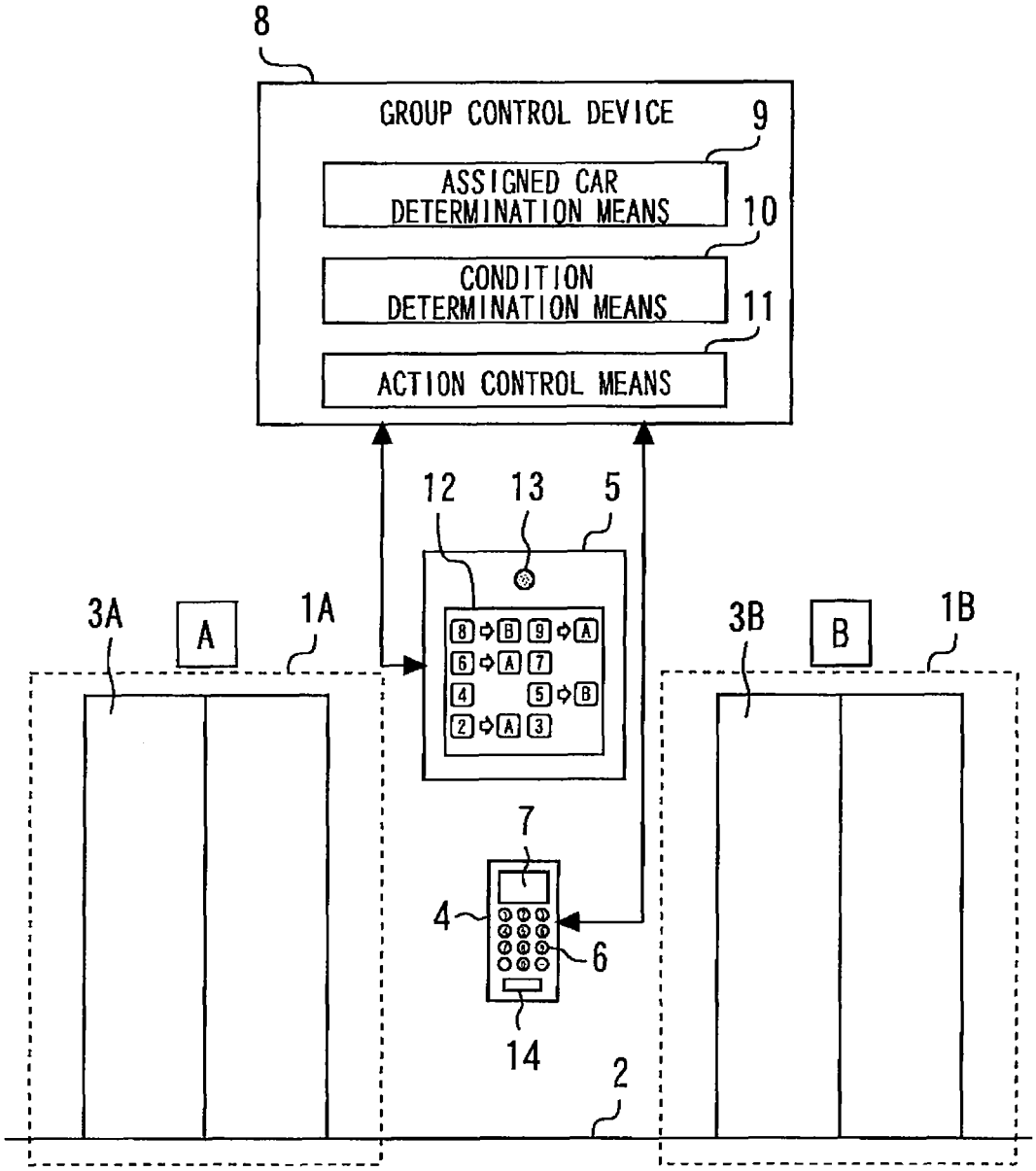
FIG. 1 is a diagram showing a configuration of an elevator system in a first embodiment according to the present invention.

FIG. 1 is a diagram showing a configuration of an elevator system in a first embodiment according to the present invention.

This elevator system controls a plurality of elevators installed in a building or the like as a group. FIG. 1 shows, as an example, the case where this elevator system performs the group control of two elevators (Elevator A and Elevator B).

In FIG. 1, reference numeral 1 denotes a car of an elevator. In the case where it is necessary to identify cars individually, A or B is attached behind the symbol. That is, a car of Elevator A is denoted by 1A and a car of Elevator B is denoted by 1B.

Reference numeral 2 denotes a hall of an elevator. Both of the car 1A and the car 1B stop at the hall 2. Reference numeral 3 denotes a hall door which opens and closes the entrance of the hall 2. Also regarding the hall door, as with the car 1, the hall door of Elevator A is denoted by 3A and the hall door of Elevator B is denoted by 3B when necessary.

A call registration device 4 and an assigned car notification device 5 are installed in the hall 2.

The call registration device 4 is a device by use of which an elevator user registers a hall destination call in the hall 2. The user can register a hall destination call by operating the call registration device 4 before boarding the car 1.

The call registration device 4 includes a service floor input portion 6 and a notification portion 7.

The service floor input portion 6 constitutes means by use of which a user inputs his or her own service floor. FIG. 1 shows, as an example, the case where the service floor input portion 6 is formed by a numeric keypad. The notification portion 7 is intended for notifying a person who operates the call registration device 4 (i.e., an elevator user) of prescribed information. FIG. 1 shows, as an example, the case where the notification portion 7 is formed by an indicator.

Upon input of a service floor from the service floor input portion 6, the call registration device 4 sends a corresponding call registration request to a group control device 8, which will be described later. A call registration request contains, for example, information on the floor on which the call registration device 4 is installed (i.e., the floor on which a user boards the car 1) and information on a service floor inputted by a user.

The group control device 8 performs the group control of a plurality of elevators. In this embodiment, the group control device 8 controls the operation of Elevator A and Elevator B. Upon receipt of a call registration request from the call registration device 4, the group control device 8 registers a hall destination call corresponding to the request. This call registration faction may be provided in the call registration device 4.

The group control device 8 includes assigned car determination means 9, condition determination means 10, and action control means 11.

The assigned car determination means 9 determines a car 1 of an elevator which is caused to respond to a registered hall destination call (an assigned car) from the cars 1 of a plurality of elevators which are group-controlled by the group control device 8. The assigned car determination means 9, for example, performs various kinds of evaluating calculations for a registered hall destination call and determines a car 1 which is caused to respond to the hall destination call.

When an assigned car is determined by the assigned car determination means 9, the action control means 11 sends information on the determined assigned car (hereinafter referred to as "assigned car determination information") to the call registration device 4 and the assigned car notification device 5. Furthermore, when an assigned car is determined by the assigned car determination means 9, the action control means 11 sends an action instruction for causing the assigned car to respond to the registered hall destination call to a control device (not shown in the drawing) which controls the assigned car.

The condition determination means 10 makes a determination as to whether or not a hall destination call registered from the call registration device 4 meets a prescribed review condition. The review condition is a condition for making a determination as to whether or not the necessity for reviewing a car 1 which is caused to respond to the hall destination call occurs later. That is, for a hall destination call which does not meet the review condition, the group control device 8 (the assigned car determination means 9) finally determines an assigned car immediately after the registration of a hall destination call.

On the other hand, for a hall destination call which meets the review condition, the assigned car determination means 9 does not finally determine an assigned car immediately after the registration of a hall destination call. For a hall destination call which is determined to meet the review condition by the condition determination means 10, an assigned car may be tentatively determined immediately after registration or the determination of an assigned car may be suspended. For a hall destination call which meets the review condition, an assigned car is finally determined by the assigned car determination means 9 in the case where a prescribed final determination condition holds (for example, the hail destination call ceases to meet the above-described review condition) after registration.

The assigned car notification device 5 is a device by use of which an elevator user makes sure of a car 1 to be boarded by the user in the hall 2. The assigned car notification device 5 includes, for example, an indicator 12 and a chime (a sound output unit) 13.

The assigned car notification device 5 indicates, on the indicator 12, information on an assigned car determined (finally determined) by the assigned car determination means 9 by correlating the information to a service floor of the assigned car. For example, the assigned car notification device 5 constantly indicates all service floors of the car 1 (each service floor of Elevator A and Elevator B) and indicates the car 1 of the elevator to be boarded by a user (i.e., a car 1 assigned to the service floor) by the side of the indications of the service floors.

In the case where, for example, the contents indicated on the indicator 12 are changed, the assigned car notification device 5 sounds the chime 13 (causes a prescribed sound to be outputted from the sound output unit) as required.

Figure 2:
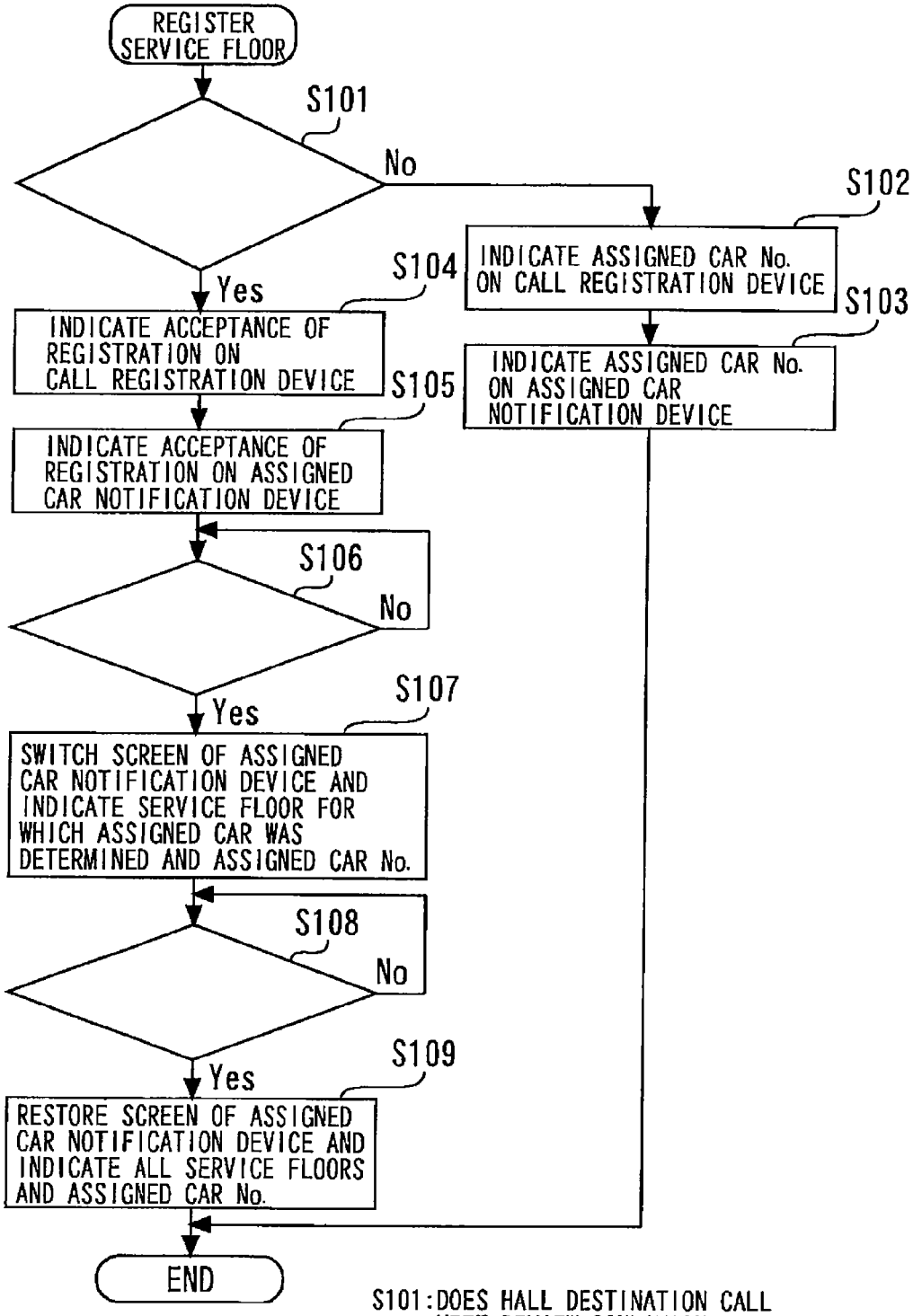
FIG. 2 is a flowchart showing the action of the elevator system in the first embodiment according to the present invention.

Next, referring to FIGS. 2 to 7 also, the action of the elevator system having the above-described configuration will be described. FIG. 2 is a flowchart showing the action of the elevator system in the first embodiment according to the present invention. FIGS. 3 to 7 are diagrams showing examples of notification of the assigned car notification device.

A person who wants to use an elevator operates the service floor input portion 6 of the call registration device 4 in a hall 2 and inputs his or her own service floor. When the input of the service floor is performed by the user, the call registration device 4 sends a corresponding call registration request to the group control device 8. Upon receipt of the call registration request from the call registration device 4, the group control device 8 registers a corresponding hall destination call.

When the registration of a hall destination call is performed, the condition determination means 10 makes a determination as to whether or not the registered hall destination call meets a prescribed review condition (S101). When it is determined by the condition determination means 10 that the registered hall destination call does not meet the review condition (No in S101), the assigned car determination means 9 finally determines a car 1 which is caused to respond to the hall destination call immediately after the registration of the hall destination call. When the assigned car determination means 9 finally determines an assigned car, the action control means 11 sends corresponding assigned car determination information to the call registration device 4 and the assigned car notification device 5.

Upon receipt of the assigned car determination information from the group control device 8, the call registration device 4 causes the notification portion 7 to provide information on a car 1 to be boarded by the user (for example, an assigned car No.) (S102).

Figure 3:
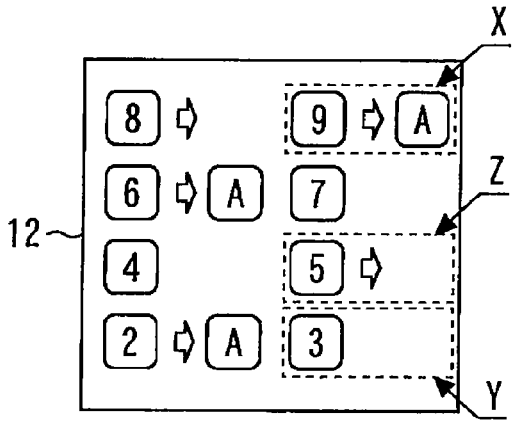
FIG. 3 is a diagram showing an example of notification of an assigned car notification device.

As shown in FIG. 3, all floors to which the user can move from the hall 2 through the use of the elevator are constantly indicated on the indicator 12 of the assigned car notification device 5. Upon receipt of the assigned car determination information from the group control device 8, the assigned car notification device 5 causes the indicator 12 to indicate information on the car 1 to be boarded by the user who performed the registration of the hall destination call from the call registration device 4 (i.e., information on the assigned car finally determined by the assigned car determination means 9: for example, an assigned car No.) by correlating the information to the service floor inputted by the user from the call registration device 4 (S103).

For example, in the case where the user inputs the 9th floor from the call registration device 4 and the car 1A of Elevator A is assigned to the hall destination call, on the basis of the assigned car determination information received from the group control device 8, the assigned car notification device 5 causes the indicator 12 to indicate "A" indicative of Elevator A (the car 1A) next to the indication of the "9th" floor as indicated by X of FIG. 3 together with an arrow. In S103, for example, by adding the arrow "→" and "A" to the existing indication without switching the screen of the indicator 12, the assigned car notification device 5 notifies the user that Elevator A is used in moving to the 9th floor.

In the case where it is determined by the condition determination means 10 that the registered hall destination call meets the review condition (Yes in S101), the assigned car determination means 9 does not perform the final determination of an assigned car for the hall destination call immediately after the registration of the hall destination call. In this case, the action control means 11 sends corresponding assigned car undeterminedness information to the call registration device 4 and the assigned car notification device 5.

Upon receipt of the assigned car undeterminedness information from the group control device 8, the call registration device 4 causes the notification portion 7 to provide information to the effect that the registration of the hall destination call has been appropriately accepted (although the assigned car has not yet been finally determined) (S104).

For a floor not inputted as a service floor from the call registration device 4, as indicated by Y of FIG. 3, only the floor name is indicated on the indicator 12. Upon receipt of the assigned car undeterminedness information from the group control device 8, the assigned car notification device 5 causes the indicator 12 to indicate information to the effect that the registration of the hall destination call has been appropriately accepted (although the assigned car has not yet been determined) by correlating the information to the service floor inputted by the user from the call registration device 4 (S105).

For example, now consider the case where the user inputs the 5th floor from the call registration device 4 and the hall destination call meets the review condition. In this case, on the basis of assigned car undeterminedness information received from the group control device 8, the assigned car notification device 5 causes the indicator 12 to indicate an arrow "→" indicative of the acceptance of registration next to the indication of the "5th" floor as indicated by Z of FIG. 3. In S105, for example, by adding an arrow to the existing indication without switching the screen of the indicator 12, the assigned car notification device 5 notifies the user that the hall destination call for going from the hall 2 to the 5th floor has been appropriately accepted.

After that, when a prescribed final determination condition holds for the hall destination call for which the final determination of the assigned car was suspended, the assigned car determination means 9 finally determines a car 1 which responds to the hall destination call (Yes in S106). When an assigned car is finally determined for the hall destination call meeting the review condition immediately after registration, the action control means 11 sends corresponding assigned car determination information to the assigned car notification device 5.

Upon receipt of the assigned car determination information after the receipt of the assigned car undeterminedness information from the group control device 8, the assigned car notification device 5 switches the screen of the indicator 12. Then the assigned car notification device 5 causes the indicator 12 to indicate a service floor inputted by the user from the call registration device 4 (i.e., a service floor corresponding to a hall destination call for which the final determination of the assigned car was suspended) and information on an assigned car assigned to the service floor (for example, an assigned car No.) (S107).

Figure 4:
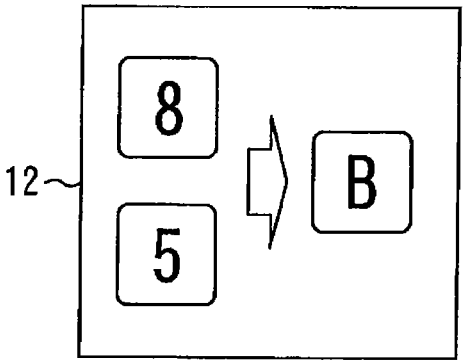
FIG. 4 is a diagram showing an example of notification of the assigned car notification device.

FIG. 4 shows an example of indication of the indicator 12 in S107. For example, as shown in FIG. 4, the assigned car notification device 5 causes the indicator 12 to indicate only information on an assigned car determined by the assigned car determination means 9 and a service floor corresponding to the hall destination call for a prescribed period of time.

FIG. 4 shows an example of indication in the case where the assigned car determination means 9 finally determined the identical assigned car for a plurality of hall destination calls meeting the review condition. In this case, the assigned car notification device 5 causes the indicator 12 to indicate simultaneously only information on the assigned car and a plurality of service floors corresponding to the hall destination calls for a prescribed period of time.

The assigned car notification device 5 may divide the indication into "5→B" and "8→B" and perform each indication for a prescribed period of time.

The assigned car notification device 5 performs the switching of the screen in S107 and makes a determination as to whether or not a prescribed period of time has elapsed after the switching of the screen (S108). When it is detected in S108 that a prescribed period of time has elapsed, the assigned car notification device 5 restores the indication of the indicator 12. That is, the assigned car notification device 5 causes the indicator 12 to indicate information on all floors that are served and information on a corresponding assigned car and acceptance of registration (S109).

Figure 5:
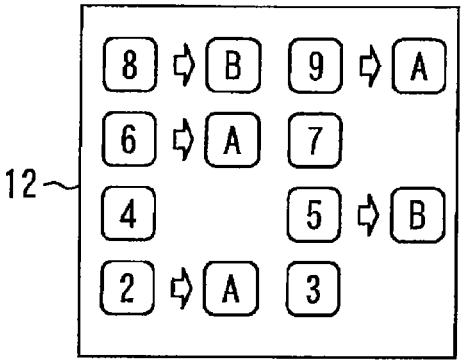
FIG. 5 is a diagram showing an example of notification of the assigned car notification device.

FIG. 5 shows an example of indication of the indicator 12 in S109. For example, now consider the case where in S107, the indication of the indicator 12 before the switching of the screen is the indication shown in FIG. 3. When in S106 Elevator B is assigned as the elevator which serves the 5th floor and the 8th floor, in S107 the assigned car notification device 5 performs the indication shown in FIG. 4. When an elapse of a prescribed period of time is detected in S108, in S109 the assigned car notification device 5 performs the indication shown in FIG. 5. At this time, on the indicator 12, "B" indicative of Elevator B (the car 1B) is indicated together with an arrow next to the indication of the "5th" floor. Furthermore, "B" indicative of Elevator B is indicated next to the indication of the "8th" floor together with an arrow.

Figure 6:
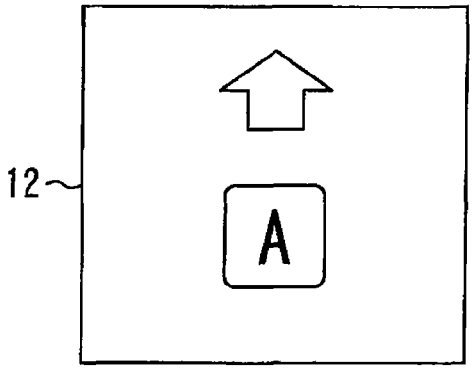
FIG. 6 is a diagram showing an example of notification of the assigned car notification device.

After that, the assigned car stops at the hall 2 in response to the registered hall destination call. When the assigned car arrives at the hall 2, the assigned car notification device 5 switches the screen of the indicator 12. Then the assigned car notification device 5 causes the indicator 12 to indicate only information on the assigned car which arrives at the hall 2 for a prescribed period of time. FIG. 6 shows an example of indication of the indicator 12 at this time. In the example shown in FIG. 6, information on an assigned car arriving at the hall 2 (for example, an assigned car No.) and an arrow indicating the moving direction of the assigned car is shown in the screen after switching.

Figure 7:
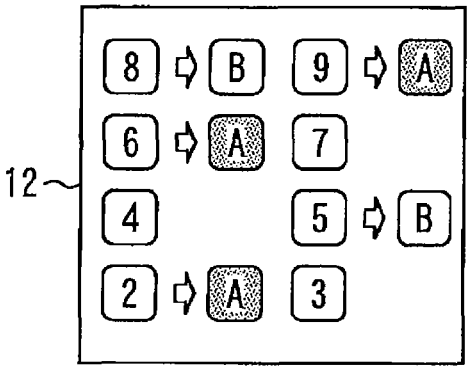
FIG. 7 is a diagram showing an example of notification of the assigned car notification device.

The indication of the indicator 12 at the time when an assigned car arrives at the hall 2 may be performed as shown in FIG. 7. FIG. 7 shows the case where at the time when an assigned car arrives at the hall 2, an indication method of the assigned car is changed for a prescribed period of time. When the assigned car arrives at the hall 2, information on the assigned car is indicated on the indicator 12 beforehand. In the example shown in FIG. 7, at the time when an assigned car arrives at the hall 2, information on the assigned car is caused to blink for a given time or the color is changed for a given time. Incidentally, in the example shown in FIG. 7, at the time when an assigned car arrives at the hall 2, the assigned car notification device 5 does not perform the switching of the screen of the indicator 12.

According to the first embodiment of the present invention, in an elevator system which controls a plurality of elevators as a group, even in the case where an assigned car is not finally determined immediately after the registration of a hall destination call, it is possible to appropriately notify a user of a car 1 to be boarded by the user.

In the elevator system of the above-described configuration, the assigned car notification device 5 may sound the chime 13 in switching the screen of the indicator 12 in S107. With this configuration, it is possible to notify a user in the hall 2 also by sound that an assigned car has been determined.

Furthermore, in the elevator system of the above-described configuration, an authentication device 14 may be installed in the call registration device 4. The authentication device 14 performs personal authentication on the basis of inputted information. The authentication device 14 sends results of authentication to the group control device 8. In this case, in switching the screen of the indicator 12 in S107, the assigned car notification device 5 may change a screen switching method on the basis of results of authentication by the authentication device 14. For example, in the case where a user is a visitor to the building or the case where a user is an elderly person, the assigned car notification device 5 indicates the screen after switching somewhat long or indicates characters and the like in a somewhat large size.

Figure 8:
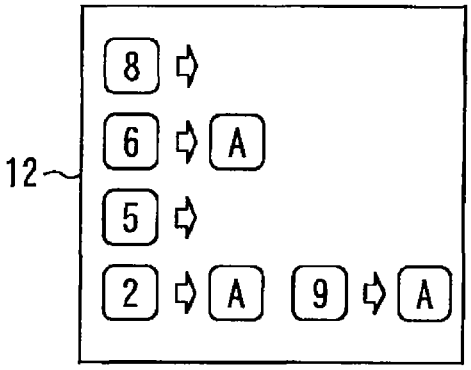
FIG. 8 is a diagram showing another example of notification of the assigned car notification device.
Figure 9:
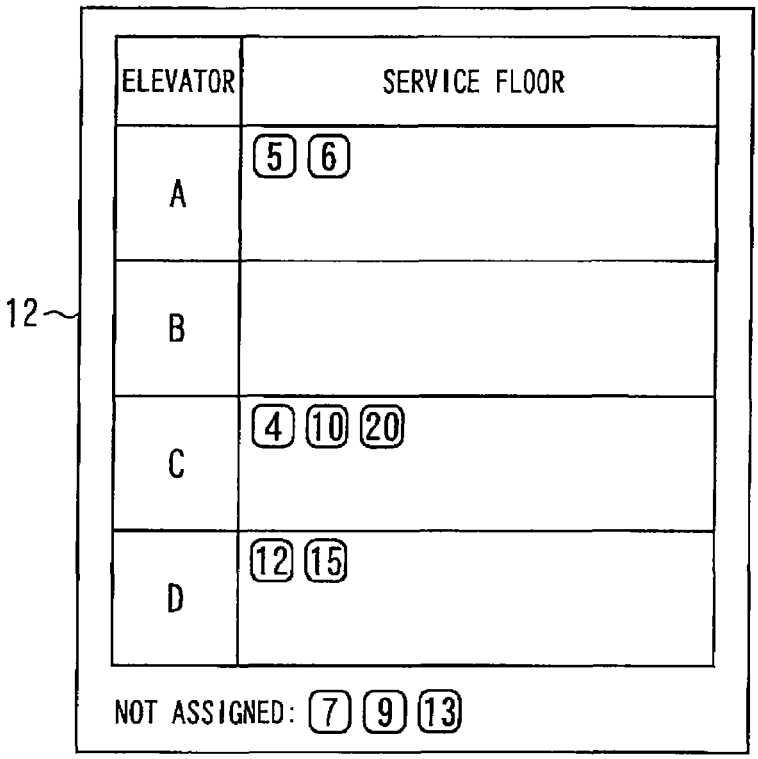
FIG. 9 is a diagram showing another example of notification of the assigned car notification device.
Figure 10:
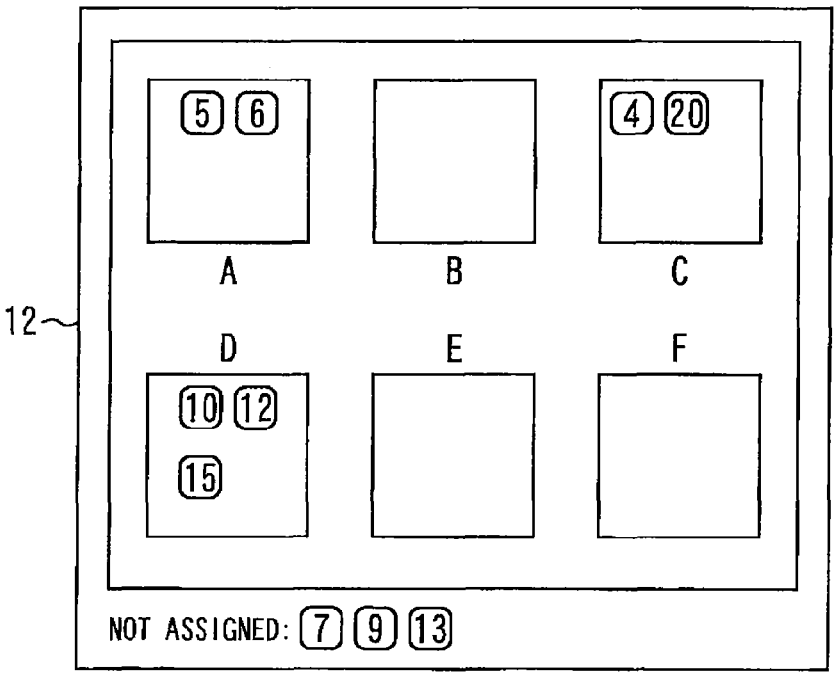
FIG. 10 is a diagram showing another example of notification of the assigned car notification device.

FIGS. 8 to 10 are diagrams showing other examples of notification of the assigned car notification device. The indication of the indicator 12 is not limited to the examples shown in FIGS. 3 to 7.

For example, in the example shown in FIG. 8, floors not inputted as service floors from the call registration device 4 among the floors served by the car 1 are not shown on the indicator 12. The assigned car notification device 5 indicates, on the indicator 12, only service floors corresponding to a hall destination call to which an assigned car does not respond (for which an assigned car does not arrive at the hall 2) among hall destination calls registered from the call registration device 4. That is, in the case where the assigned car notification device 5 has received assigned car determination information or assigned car undeterminedness information from the group control device 8, the assigned car notification device 5 for the first time indicates a service floor corresponding to the information on the indicator 12.

Furthermore, in the example shown in FIG. 9, information on service floors is shown on the indicator 12 for each elevator. In this case, upon receipt of assigned car determination information from the group control device 8, the assigned car notification device 5 causes information on service floors to be indicated in an indication area assigned to the assigned car. Upon receipt of assigned car undeterminedness information from the group control device 8, the assigned car notification device 5 causes information on service floors for which the acceptance of registration was performed to be indicated in an area different from the above-described indication area.

In the example shown in FIG. 10, as with the example shown in FIG. 9, information on service floors is shown on the indicator 12 for each elevator. Also, in the example shown in FIG. 10, the indication area of each elevator is appropriately laid out and indicated so that the installation position of each elevator can be seen.

INDUSTRIAL APPLICABILITY

The elevator system of the present invention can be applied to a system which controls a plurality of elevators as a group.

REFERENCE SIGNS LIST

1 car
2 hall
3 hall door
4 call registration device
5 assigned car notification device
6 service floor input portion
7 notification portion
8 group control device
9 assigned car determination means
10 condition determination means
11 action control means
12 indicator
13 chime
14 authentication device

The invention claimed is:

1. An elevator system which controls a plurality of elevators as a group, comprising:

a call registration device which is installed in an elevator hall and by use of which a user registers a hall destination call;

a group control device which upon registration of a hall destination call from the call registration device, determines an assigned car which is caused to respond to the hall destination call; and an assigned car notification device which is installed in the hall and indicates, on an indicator, information on an assigned car determined by the group control device by correlating the information to a service floor of the assigned car, the information indicating all floors to which the user can move via the plurality of elevators; wherein the group control device makes a determination as to whether or not a hall destination call registered from the call registration device meets a prescribed review condition and does not perform a final determination of an assigned car immediately after registration of a hall destination call which meets the review condition, upon final determination of an assigned car for a hall destination call meeting the review condition by the group control device, the assigned car notification device indicates only information on the assigned car and a service floor corresponding to the hall destination call on the indicator for a prescribed period of time, and in response to arrival of an assigned car at the hall, the assigned car notification device switches the screen of the indicator and indicates only information on the assigned car arriving at the hall for a prescribed period of time.

2. The elevator system according to claim 1, wherein the assigned car notification device indicates, in normal times, all service floors corresponding to a hall destination call to which an assigned car does not respond among hall destination calls registered from the call registration device by correlating the service floors to information on the assigned car, and upon final determination of an assigned car for a hall destination call meeting the review condition by the group control device, the assigned car notification device switches the screen of the indicator and indicates only information on the assigned car and a service floor corresponding to the hall destination call on the indicator.

3. The elevator system according to claim 2, wherein in switching the screen of the indicator, the assigned car notification device causes a sound output unit to output a prescribed sound.

4. The elevator system according to claim 2, wherein upon arrival of an assigned car at the hall, the assigned car notification device changes a method of indicating information on the assigned car for a prescribed period of time.

5. The elevator system according to claim 2, wherein the call registration device includes an authentication device which performs personal authentication on the basis of inputted information, and in switching the screen of the indicator, the assigned car notification device changes a screen switching method on the basis of authentication results of the authentication device.

6. The elevator system according to claim 1, wherein upon final determination of an identical assigned car for a plurality of hall destination calls meeting the review condition by the group control device, the assigned car notification device simultaneously indicates information on the assigned car and a plurality of service floors corresponding to the plurality of hall destination calls on the indicator.

7. A method which controls a plurality of elevators as a group, comprising:

registering, via a call registration device which is installed in an elevator hall, a hall destination call;

determining, via a group control device and upon registration of a hall destination call from the call registration device, an assigned car which is caused to respond to the hall destination call;

indicating, on an assigned car notification device which is installed in the hall, information on an assigned car determined by the group control device by correlating the information to a service floor of the assigned car, the information indicating all floors to which a user can move via the plurality of elevators;

determining, via the group control device, whether or not a hall destination call registered from the call registration device meets a prescribed review condition and not performing a final determination of an assigned car immediately after registration of a hall destination call which meets the review condition;

indicating, via the assigned car notification device and upon final determination of an assigned car for a hall destination call meeting the review condition by the group control device, only information on the assigned car and a service floor corresponding to the hall destination call on an indicator for a prescribed period of time; and switching, via the assigned car notification device and in response to arrival of an assigned car at the hall, the screen of the indicator and indicating only information on the assigned car arriving at the hall for a prescribed period of time.

* * * * *